US009456280B2

(12) United States Patent
Zhang et al.

(10) Patent No.: US 9,456,280 B2
(45) Date of Patent: Sep. 27, 2016

(54) ELECTROMAGNETIC TRANSDUCER

(71) Applicants: Guqing Zhang, Shenzhen (CN); Zhongping Li, Shenzhen (CN)

(72) Inventors: Guqing Zhang, Shenzhen (CN); Zhongping Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 65 days.

(21) Appl. No.: 14/514,545

(22) Filed: Oct. 15, 2014

(65) Prior Publication Data

US 2015/0189442 A1 Jul. 2, 2015

(30) Foreign Application Priority Data

Dec. 31, 2013 (CN) ..... 2013 2 0893204 U

(51) Int. Cl.
*H04R 3/00* (2006.01)
*H04R 9/02* (2006.01)
*H04R 9/10* (2006.01)

(52) U.S. Cl.
CPC ..... *H04R 9/025* (2013.01); *H04R 9/10* (2013.01); *H04R 2400/03* (2013.01); *H04R 2499/11* (2013.01)

(58) Field of Classification Search
CPC ..... H04R 9/025
USPC ..... 381/409, 191, 433
See application file for complete search history.

(56) References Cited

U.S. PATENT DOCUMENTS

2013/0016874 A1* 1/2013 Huang ..... H04R 9/043 381/433
2013/0156237 A1* 6/2013 Kim ..... H04R 9/06 381/191

* cited by examiner

*Primary Examiner* — Duc Nguyen
*Assistant Examiner* — Phan Le
(74) *Attorney, Agent, or Firm* — Na Xu; IPro, PLLC

(57) ABSTRACT

An electromagnetic transducer is disclosed in the present invention. The electromagnetic transducer includes a frame including a receiving space; an assistant member made of metal material and embedded in the frame; a magnetic circuit unit having a magnetic gap and received in the receiving space; a diaphragm facing the magnetic circuit unit and mounted on the frame and a voice coil partially received in the magnetic gap for driving the diaphragm to vibrate and generate sound.

14 Claims, 5 Drawing Sheets

ELECTROMAGNETIC TRANSDUCER

FIELD OF THE INVENTION

The present invention relates to electromagnetic transducers, and more specifically to an electromagnetic transducer for providing multiple functions.

DESCRIPTION OF RELATED ART

With the rapid development of the portable devices such as cellular phones, people request for more and more functions. In the field of music enjoying of the cellular phone, a multifunction device enabling providing both audible and tactile sensations for amusement has already been widely used, which boosts the quick development of multifunctional devices.

An electromagnetic transducer in the related art comprises a frame, a magnetic circuit unit received in the frame, and a vibration unit attached to the frame. However, said frame is made of plastic material. When the electromagnetic transducer is miniaturized, the frame becomes smaller and smaller, the structural strength of the frame is too low to support the magnetic circuit unit and vibration unit, which leads to failure of the transducer. Thus, the electromagnetic transducer couldn't satisfy users' demands for good performance.

Therefore, it is desirable to provide a new multifunctional electromagnetic transducer for solving the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe the exemplary embodiment of the present invention in detail.

Figure 1:
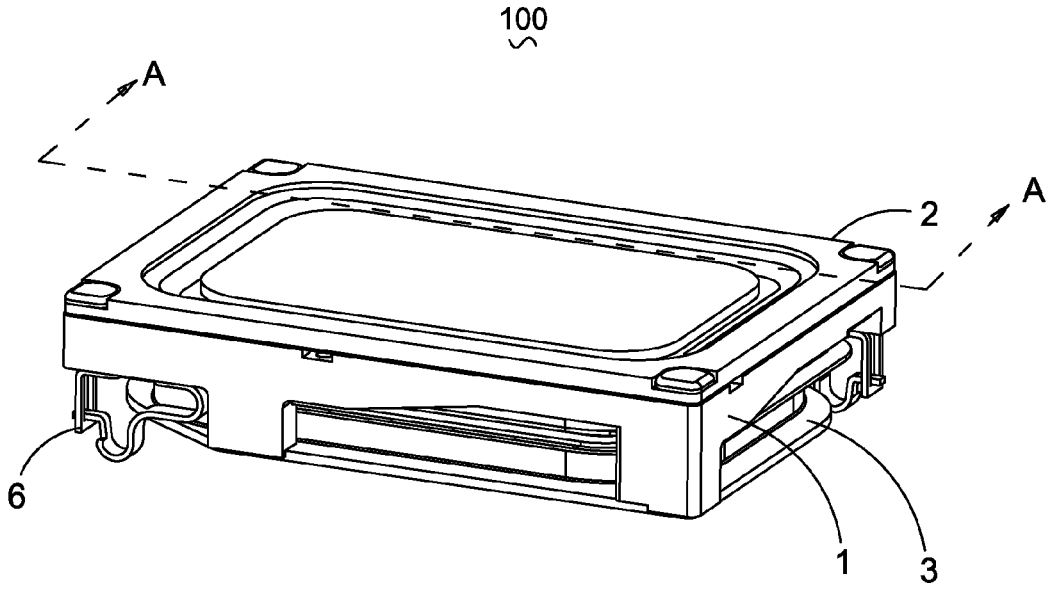
FIG. 1 is an illustrative isometric view of an electromagnetic transducer according to an exemplary embodiment of the present invention.
Figure 2:
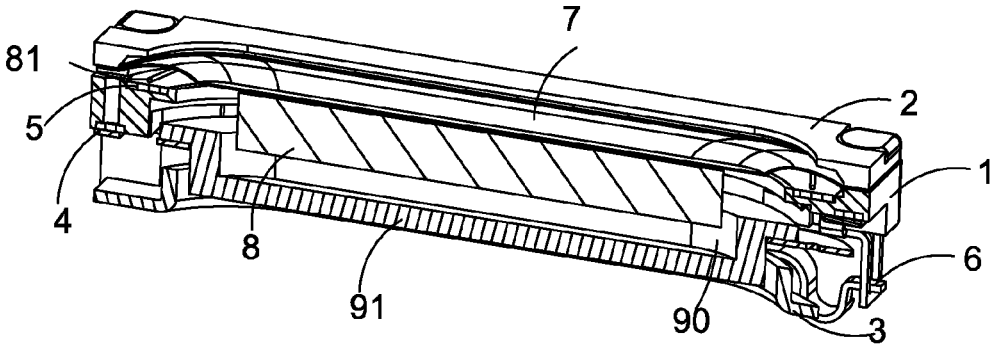
FIG. 2 is a cross-sectional view of the electromagnetic transducer taken along line A-A of FIG. 1.
Figure 3:
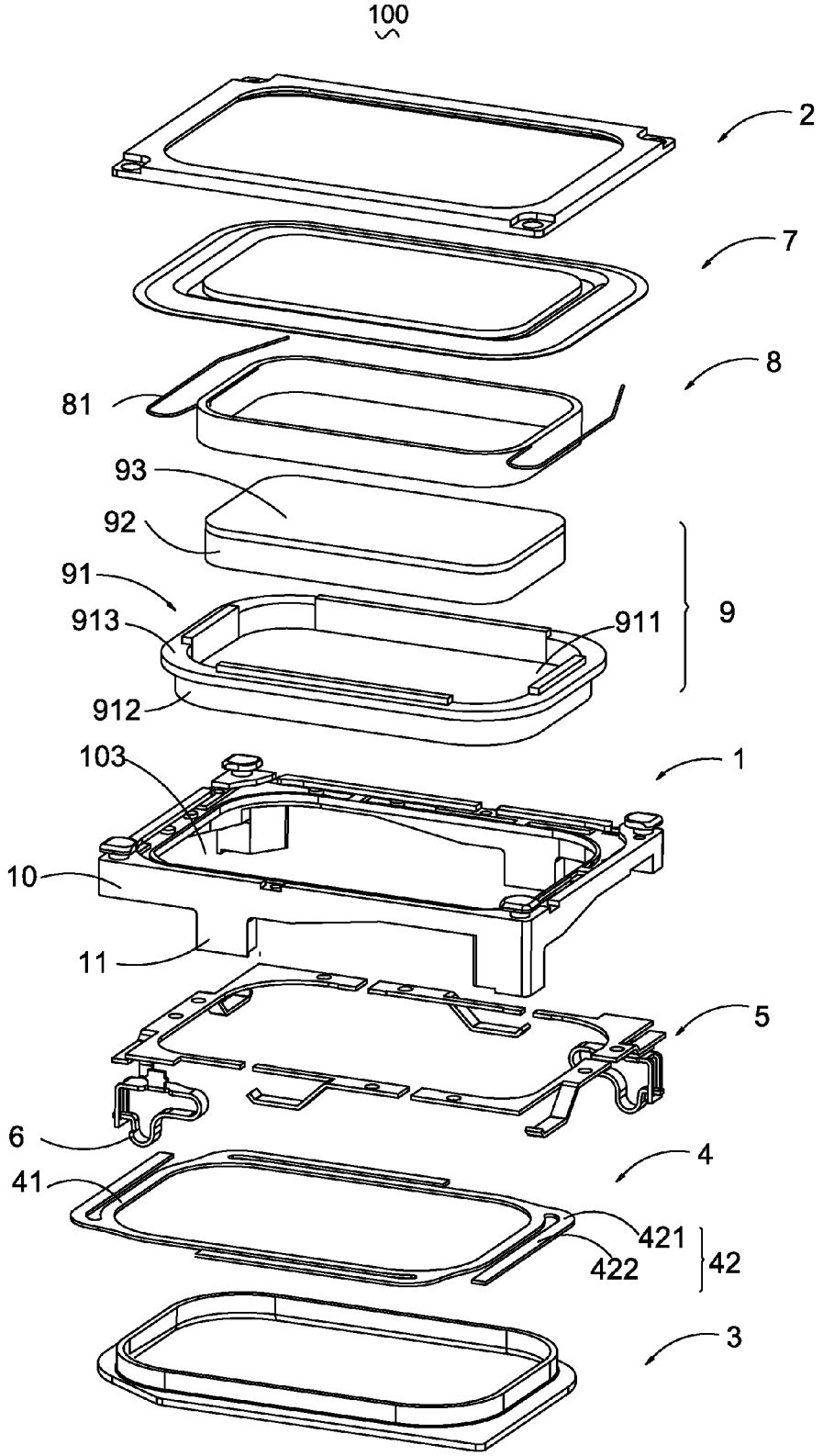
FIG. 3 an exploded view of the electromagnetic transducer shown in FIG. 1.

Referring to FIGS. 1-3, an electromagnetic transducer 100 comprises a frame 1, a bottom cover 3 assembled with the frame 1, an assistant member 5 embedded in the frame 1, a suspension 4 mounted on the frame 1 through the assistant member 5, a magnetic circuit unit 9 including a magnetic gap 90 and suspended in the frame 1 by the suspension 4, a diaphragm 7 facing the magnetic circuit unit 9 and fixed on the frame 1, a voice coil 8 having a pair of wire leads 81 and partially inserted into the magnetic gap 90 for driving the diaphragm 7 to vibrate and generate sound, a pair of terminals 6 electrically connected to the wire leads 81 respectively for applying electrical signal to the voice coil 8, and a top cover 2 pressing a periphery of the diaphragm 7 for fixing the diaphragm 7 to the frame 1. Optionally, the electromagnetic transducer 100 has no suspension or terminals, with the magnetic circuit unit directly connected to the frame.

The magnetic circuit unit 9 comprises a yoke 91, a magnet 92 received in the yoke 91 and a pole plate 93 attached on the magnet 92. In this embodiment, the yoke 91 includes a bottom wall 911, a sidewall 912 extending from the bottom wall 911 toward the top cover 2 and a flange 913 extending outward from a top surface of the sidewall 912 along a direction parallel to the bottom wall 911. The magnet 92 is positioned in a central portion of the bottom wall 911 and spaced from an inner surface of the sidewall 912. Thus, the magnetic gap 90 is accordingly formed between the magnet 92 and the inner surface of the sidewall 912.

The suspension 4 comprises a suspending ring 41 for supporting the yoke 91 and at least two elastic arms 42 arranged around the suspending ring 41. Optionally, there are four elastic arms 42 provided in the suspension 4, which are arranged around the suspending ring 41 in a clockwise direction. Each elastic arm 42 comprises an arc segment 421 connected with the suspending ring 41 for undergoing elastic deformation and supplying elastic force to the yoke 91 while vibrating, and a straight segment 422 extending straightly from the arc segment 421 for connecting with the frame 1.

Figure 4:
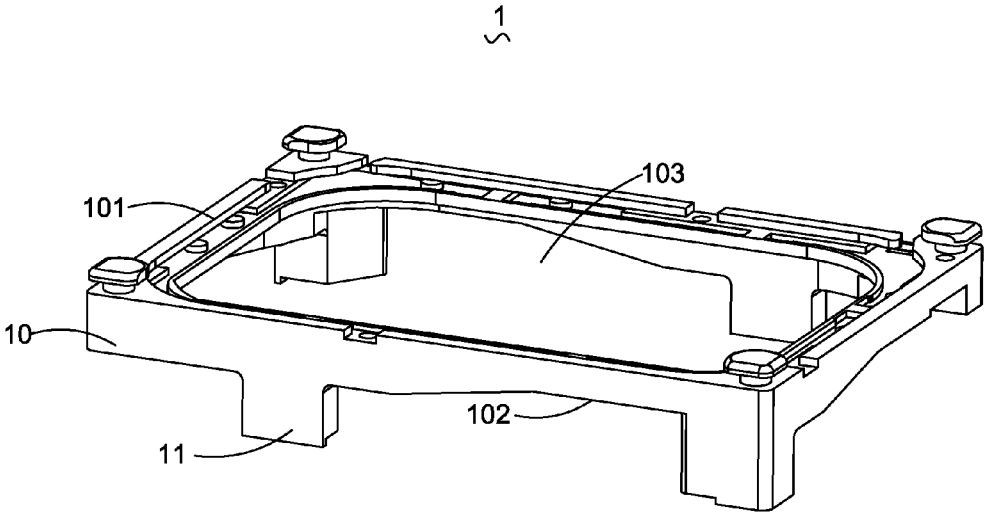
FIG. 4 is an illustrative isometric view of a frame of the electromagnetic transducer shown in FIG. 3.
Figure 5:
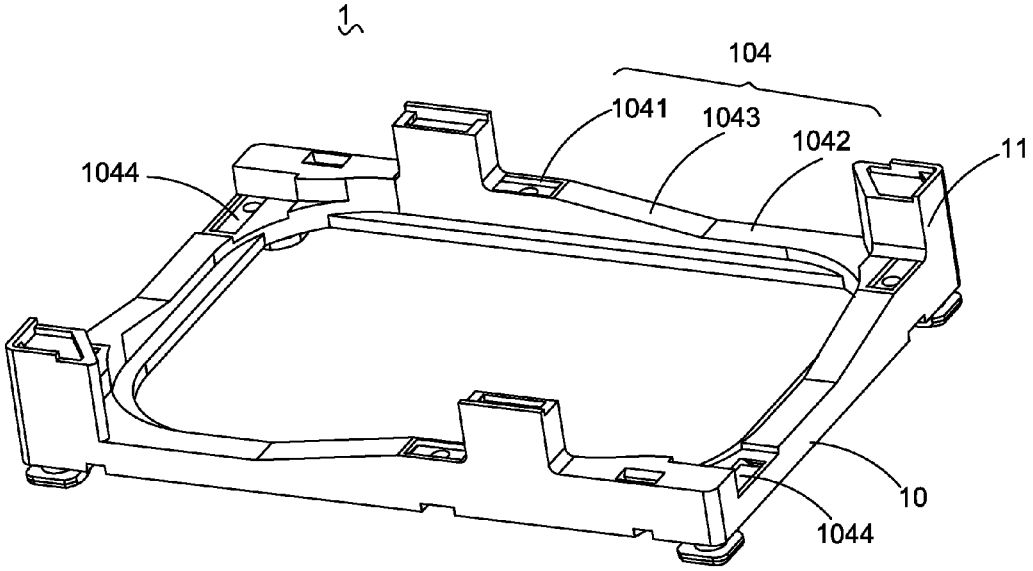
FIG. 5 is an illustrative isometric view of the frame shown in FIG. 4, but from another aspect.

Referring to FIG. 4 and FIG. 5, the frame 1 comprises a base case 10 including a receiving space 103 and at least two supporting legs 11 connected with the base case 10 for supporting the frame 1. In this embodiment, four supporting legs 11 are provided in the frame 1 for improving the stability of the frame 1. The four supporting legs 11 locate spaced from each other. The base case 10 is substantially rectangle shaped and comprises an upper surface 101 facing the top cover 2 and a lower surface 102 opposite to the upper surface 101.

Especially referring to FIG. 5, the lower surface 102 includes four mounting areas. The base case 10 further comprises four connecting segments 104 formed on the mounting areas respectively for connecting with the suspension 4. Each of the connecting segments 104 comprises a first connecting portion 1041, a prevent collision portion 1042, and a inclining portion 1043 extending from the first connecting portion 1041 to the prevent collision portion 1042. The vertical distance between the first connecting portion 1041 and the upper surface 101 is higher than that between the prevent collision portion 1042 and the upper surface 101. Optionally, The base case 10 further comprises a pair of second connecting portions 1044 formed on two corners of the lower surface 102 of the base case 10, which locate symmetrically about a center of the base case 10.

Figure 6:
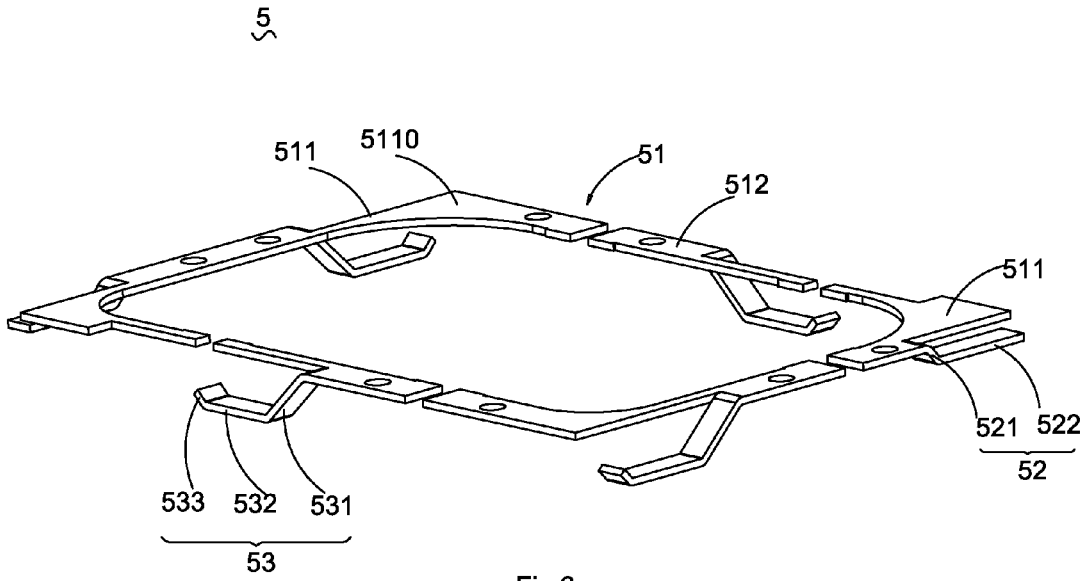
FIG. 6 is an illustrative isometric view of an assistant member of the electromagnetic transducer shown in FIG. 3.
Figure 7:
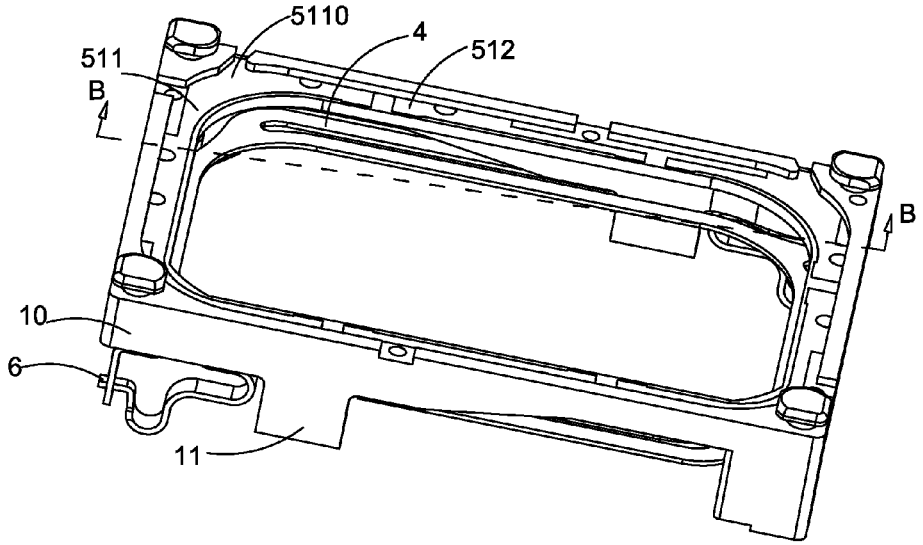
FIG. 7 is an illustrative assembled view of a combination of the assistant member, the frame and a suspension of the electromagnetic transducer shown in FIG. 3.
Figure 8:
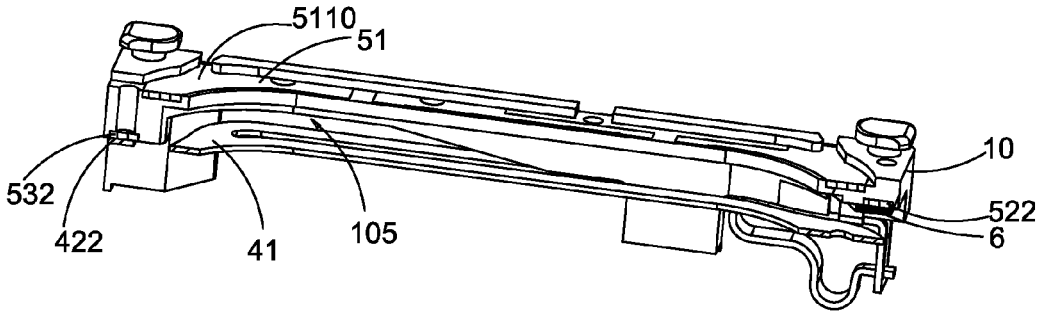
FIG. 8 is a cross-sectional view of the combination of the assistant member, the frame and the suspension, taken along line B-B of FIG. 7.
Figure 9:
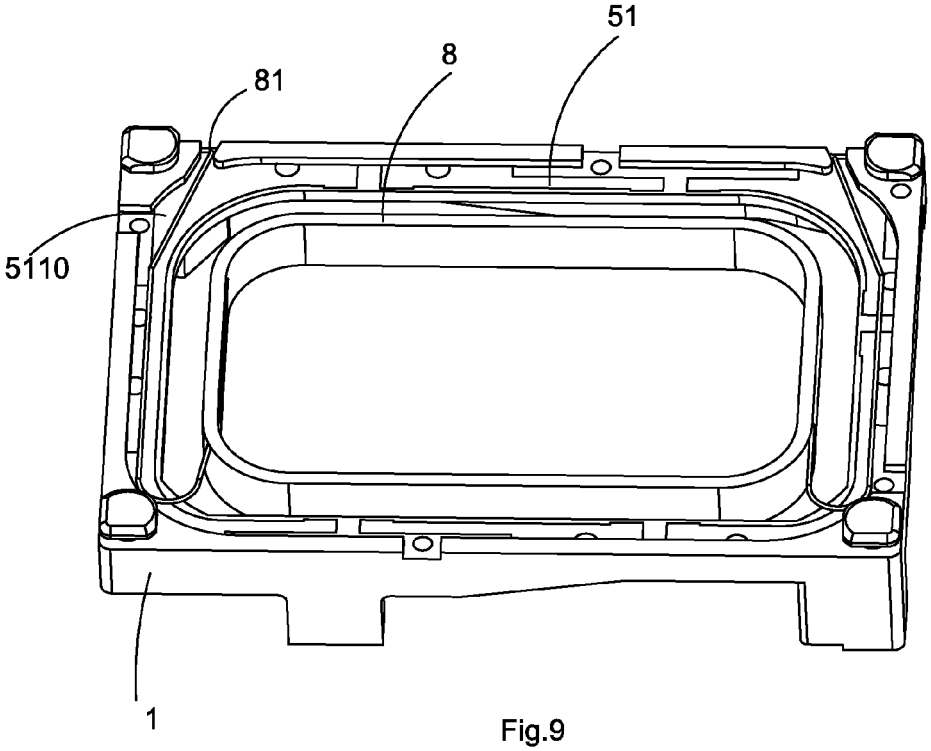
FIG. 9 is a an illustrative assembled view of a combination of the assistant member, the frame, the suspension, a magnetic circuit unit and a voice coil of the electromagnetic transducer shown in FIG. 3.

Referring to FIG. 6, the assistant member 5 is made of metal material and comprises a ring-shaped base body 51 and at least two first connecting arms 53 extending from the base body 51 toward the lower surface 102.

The base body 51 comprises a pair of straight plates 512 opposite to each other and a pair of U-shaped plates 511 opposite to each other. Each straight plate 512 locates between the two U-shaped plates 511 and spaced from the U-shaped plates 511. The straight plates 512 and U-shaped plates 511 are arranged so that the base body 51 is shaped to match the base case 10.

In this embodiment, four first connecting arms 53 are provided, which are connected to the straight plates 512 and U-shaped plates 511 respectively, arranged around the base body 51 in a clockwise direction, and corresponding to the elastic arms 42 of the suspension 4 one by one. Each first connecting arm 53 comprises a first bending portion 531 extending obliquely from the base body 51 toward the lower surface 102, a first soldering pad 532 extending from the first bending portion 531 along a direction parallel to the base body 51 and a second bending portion 533 extending obliquely from the first soldering pad 532 toward the upper surface 101.

The assistant member 5 further comprises a pair of second connecting arms 52 extending obliquely from the U-shaped plates 511 respectively in a direction toward the lower surface 102 for electrically soldering the terminals 6 thereon. The second connecting arms 52 locate symmetrically about a center of the base body 51 and corresponding to the second connecting portion 1044 one by one. Each second connecting arm 52 comprises a third bending portion 521 extending obliquely from the U-shaped plate 511 toward the lower surface 102 and a second soldering pad 522 extending from the third bending portion 521 along a direction parallel to the U-shaped plate 511.

The assistant member 5 further comprises a pair of third soldering pads 5110 formed on the corners of the U-shaped plates 511 respectively for electrically soldering the wire leads 81 of the voice coil 8 thereon. The third soldering pads 5110 locate on the same side of the base body 51.

Referring to FIG. 2, FIG. 7, FIG. 8 and FIG. 9, when assembled, the assistant member 5 is integrated with the frame 1 by insert-molding. Optionally, the assistant member 5 can also be connected with the frame by other means, such as complementary structures, adhesive, or the like. Specifically, the base body 51 of the assistant member 5 is attached on the upper surface 101 of the base case 10 of the frame 1. The first connecting arm 53 penetrates the base case 10 from the upper surface 101 to the lower surface 102 and the first soldering pad 532 of the first connecting arm 53 exposes from the first connecting portion 1041 of the base case 10. The second connecting arm 52 penetrates the base case 10 from the upper surface 101 to the lower surface 102 and the second soldering pad 522 exposes from the second connecting portion 1044 of the base case 10. With the construction of the assistant member 5, the structural strength of the frame 1 can increase.

The suspension 4 is received in the receiving space 103. The distal end of the straight segment 422 of the suspension 4 is connected with the first soldering pad 532 by soldering, which make the suspension 4 connect to the frame 1 more firmly. The suspending ring 41 of the suspension 4 engages with the supporting legs 11. A space 105 is formed between the prevent collision portion 1042 and the suspension 4 to supply sufficient vibrating space for the suspension 4. In such case, the suspension 4 will not occupy the space of the frame 1, and thus increase the vibrating space of the magnetic circuit unit 9.

The terminals 6 are connected to the second soldering pads 522 of the second connecting arms 52 respectively by soldering.

The magnetic circuit unit 9 is received in the suspending ring 41 and supported by such suspending ring 41. Specifically, the flange 913 of the yoke 91 of the magnetic circuit unit 9 engages with the suspending ring 41, so that the magnetic circuit unit 9 can be elastically supported well by the suspension 4. A gap is formed between the flange 913 and the inner surface of the base case 10 to prevent the magnetic circuit unit 9 from moving up too much in non-work state.

The voice coil 8 partially inserted into the magnetic gap 90 of the magnetic circuit unit 9 and the wire leads 81 of the voice coil 8 are connected to the third soldering pads 5110 of the base body 51 respectively by soldering, so that the electric signal from the terminal 6 can be transmitted to the wire lead 81 through the assistant member 5.

The disclosure provides an electromagnetic transducer having a frame, an assistant member made of metal material. The assistant member is embedded in the frame. In such case, the structural strength of the frame can increase.

It is to be understood, however, that even though numerous characteristics and advantages of the present disclosure have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electromagnetic transducer comprising, a frame including a receiving space, an upper surface and a lower surface opposite to the upper surface;

an assistant member made of metal material and including a base body attached on the upper surface, and at least two first connecting arms extending from the base body in a direction toward the lower surface and penetrating the frame from the upper surface to the lower surface;

a suspension received in the receiving space, and assembled with the frame via connected to the first connecting arms;

a magnetic circuit unit suspended in the receiving space by the suspension, and including a magnetic gap;

a diaphragm facing the magnetic circuit unit and mounted on the frame;

a voice coil partially received in the magnetic gap for driving the diaphragm to vibrate and generate sound.

2. The electromagnetic transducer of claim 1 further comprising a pair of terminals electrically connected with the voice coil via the assistant member.

3. The electromagnetic transducer of claim 2, wherein each first connecting arm comprises a first bending portion extending obliquely from the base body in a direction toward the lower surface and a first soldering pad extending from the first bending portion in a direction parallel to the base body.

4. The electromagnetic transducer of claim 3, wherein the assistant member further comprises a pair of second connecting arms arranged symmetrically about a center of the base body and extending obliquely from the base body in a direction toward the lower surface for electrically soldering the terminals thereon.

5. The electromagnetic transducer of claim 4, wherein the assistant member further comprises a pair of third soldering pads formed on two corners of the base body for electrically connected with the voice coil.

6. The electromagnetic transducer of claim 1, wherein the suspension comprises a suspending ring and at least a pair of elastic arms connected with the suspending ring, arranged opposite to each other and connected to the first connecting arms respectively by soldering.

7. An electromagnetic transducer comprising, a frame including a base case having a receiving space and at least two supporting legs connected to the base case for supporting the frame, the base case including an upper surface and a lower surface opposite to the upper surface;

a strengthening member made of metal material and embedded in the base case, the strengthening member including a base body attached on the upper surface, and at least two first connecting arms extending from the base body toward the lower surface and penetrating the base case from the upper surface to the lower surface;

a suspension mounted on the frame by welding the suspension to the first connecting arms;

a magnetic circuit unit having a magnetic gap and suspended in the receiving space by the suspension;

a diaphragm facing the magnetic circuit unit;

a voice coil including a pair of wire leads and partially received in the magnetic gap for driving the diaphragm to vibrate and generate sound;

a pair of terminals electrically connected with the wire leads respectively.

8. The electromagnetic transducer of claim 7, wherein each first connecting arm comprises a first bending portion extending obliquely from the base body toward the lower surface and a first soldering pad extending from the first bending portion in a direction parallel to the base body.

9. The electromagnetic transducer of claim 8, wherein the strengthening member further comprises a pair of second connecting arms arranged symmetrically about a center of the base body and extending obliquely from the base body toward the lower surface for electrically soldering the terminals thereon.

10. The electromagnetic transducer of claim 9, wherein the strengthening member further comprises a pair of third soldering pads formed on two corners of the base body for electrically soldering the wire leads thereon.

11. The electromagnetic transducer of claim 10, wherein the suspension comprises a suspending ring and at least a pair of elastic arms connected with the suspending ring, arranged opposite to each other and connected to the first connecting arms by soldering.

12. The electromagnetic transducer of claim 7, wherein the base case further comprises a plurality of connecting segments formed on the lower surface, each connecting segment comprises a first connecting portion, a prevent collision portion, and a inclining portion extending from the first connecting portion to the prevent collision portion; wherein a vertical distance between the first connecting portion and the upper surface is higher than that between the prevent collision portion and the upper surface.

13. The electromagnetic transducer of claim 1, wherein, the assistant member and the frame are integrally formed as one unit.

14. The electromagnetic transducer of claim 7, wherein, the strengthening member and the frame are integrally formed as one unit.

* * * * *